US005607333A

United States Patent [19]

Kvamsdal

[11] Patent Number: 5,607,333

[45] Date of Patent: Mar. 4, 1997

[54] COOLING WATER INLET AND METHOD OF FABRICATING A COOLING WATER INLET MEMBER

[75] Inventor: Rolf Kvamsdal, Trondheim, Norway

[73] Assignee: Kvaerner A.S., Oslo, Norway

[21] Appl. No.: 507,340

[22] PCT Filed: Feb. 18, 1994

[86] PCT No.: PCT/NO94/00040

§ 371 Date: Aug. 14, 1995

§ 102(e) Date: Aug. 14, 1995

[87] PCT Pub. No.: WO94/19237

PCT Pub. Date: Sep. 1, 1994

[30] Foreign Application Priority Data

Feb. 25, 1993 [NO] Norway ..... 930678

[51] Int. Cl.[6] ..... B63H 21/10

[52] U.S. Cl. ..... 440/88

[58] Field of Search ..... 440/38, 46, 47, 440/88; 60/221; 165/41, 44

[56] References Cited

U.S. PATENT DOCUMENTS 1,862,282 7/1932 Schmidt .
1,884,282 10/1932 Schmidt .
3,561,524 2/1971 Satterthwaite ..... 440/88
3,765,364 10/1973 Booth .
4,069,788 1/1978 Nitzki ..... 440/88
5,106,330 4/1992 Nelson et al. ..... 440/88

FOREIGN PATENT DOCUMENTS 865899 6/1941 France .

*Primary Examiner*—Stephen Avila
*Attorney, Agent, or Firm*—Merchant, Gould, Smith, Edell, Welter & Schmidt, P.A.

[57] ABSTRACT

A cooling water intake (1) is constructed as an integral body from a composite material, having a duct (2) running from a first opening (3), adapted to face toward the sea, and to a second opening (4), where the cooling water intake may be connected to the cooling water system of a motor. The duct (2) is curved inward and toward the stern, and the duct cross section is flattened near the first opening, which faces to the sea. Toward the second opening (4) the cross section of the duct progresses into a conventional circular cross section. The invention also relates to a method for fabricating a cooling water intake body.

5 Claims, 2 Drawing Sheets

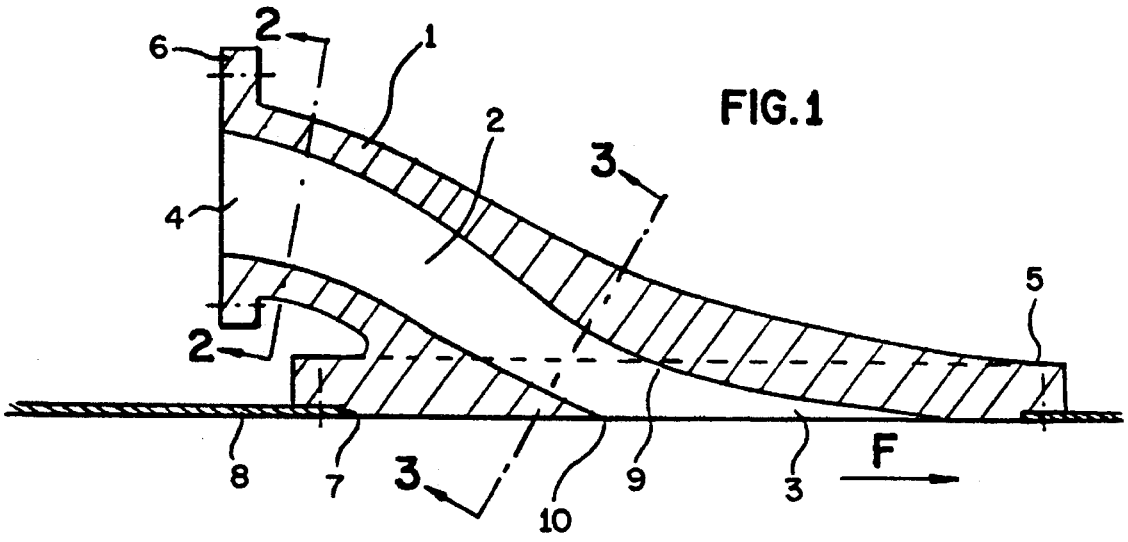
FIG. 1
FIG. 2
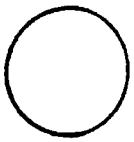
FIG. 3
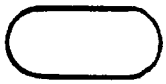
FIG. 4
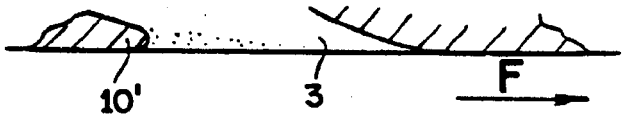
FIG. 5
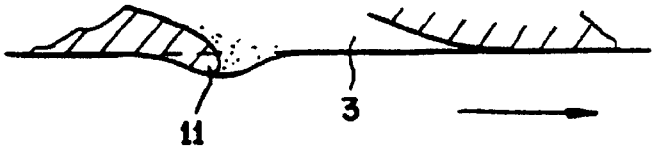

FIG. 6
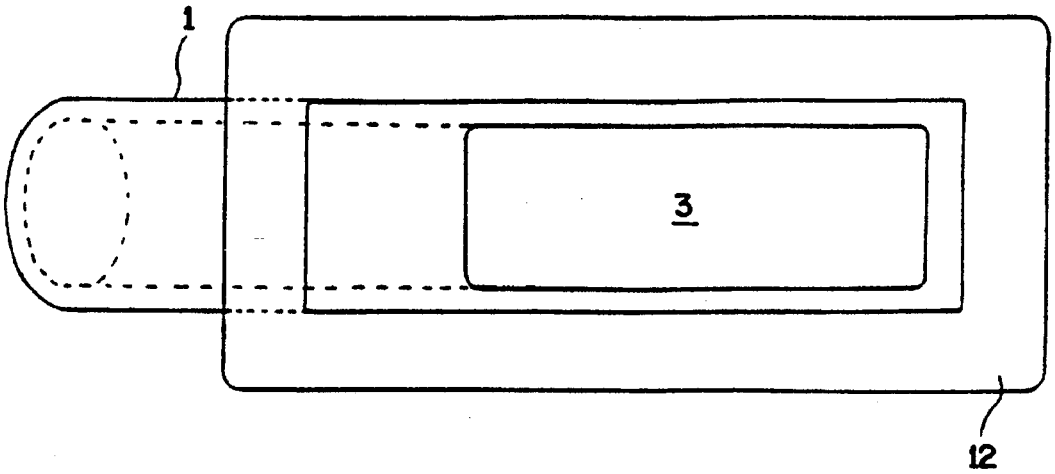
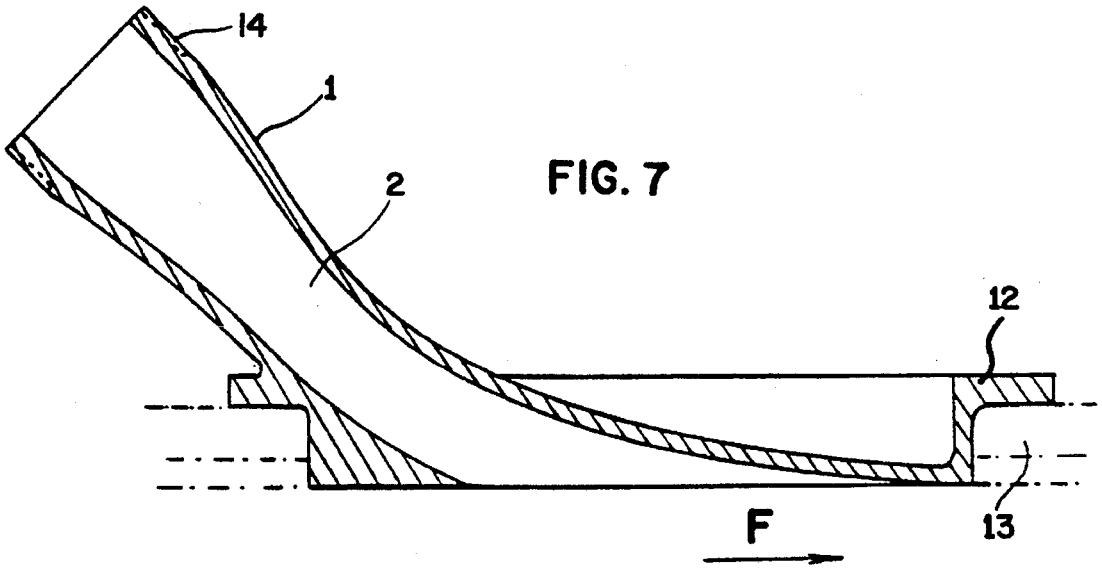
FIG. 7
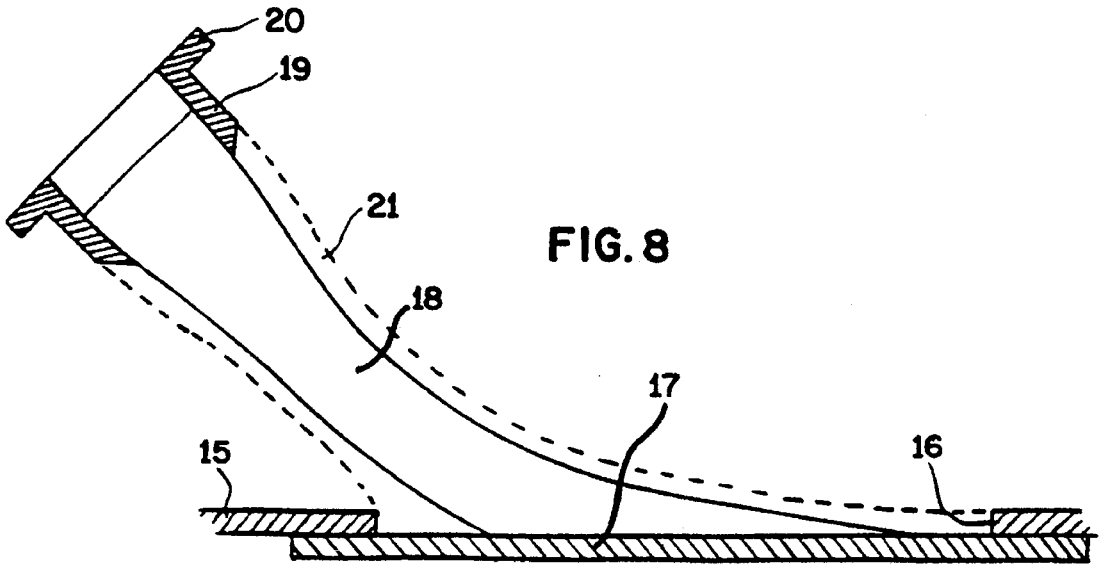
FIG. 8

COOLING WATER INLET AND METHOD OF FABRICATING A COOLING WATER INLET MEMBER

BACKGROUND OF THE INVENTION

The invention relates to a cooling water intake for use aboard a boat, comprising a first opening to the sea in the boat hull, a duct for water from the opening, and a second opening at the mouth of the duct, which second opening is adapted for connection to the cooling water system of a motor.

The invention also relates to a method for fabricating a cooling water intake body.

SUMMARY OF THE INVENTION

Cooling water intake aboard relatively small boats, i.e., vessels in the size range of leisure boats, have a simple cooling water intake that includes an opening in the boat hull and a duct for water from this opening and to a second opening, which is attached to the motor's cooling water System. The opening in the boat hull is oriented at a right angle to the hull side or bottom, and is frequently surrounded by an exterior end flange abutting with the outside of the hull skin. Observations often indicate that the inflow of cooling water to the motor is insufficient, particularly at greater speeds. The possible reason(s) for this have not been thoroughly investigated in connection with the invention, but instead an attempt has been made to develop a cooling water intake that provides an improved, stable and reliable supply of cooling water to the boat motors, even at maximum speeds (45 knots and thereaboats for leisure/pleasure boats and the like). In addition, it is also an object of the invention to provide a cooling water intake that may easily be adapted to various types and sizes of hulls.

It is also an objective of the invention to enable the prefabrication of a suitable cooling water intake, thereby to provide a unit that may be inserted into the boat hull of new structures as well as existing boats.

Still another objective of the invention is to disclose a method for fabrication of a cooling water intake in situ.

According to the invention, therefore, we propose a cooling water intake as described above, characterized in that the duct running from said first opening is curved inward and toward the stern.

Such a duct configuration will ensure a sufficient, stable supply of cooling water even under the highest prevailing speeds for boats of the type in question here.

It has proven particularly convenient for the cooling water intake to be formed as an integral body, thus providing an insertable member which may easily be mounted and adapted.

It is especially advantageous for this integral body to be constructed of a suitable composite material. An advantage attained thereby is that the area surrounding said first opening, i.e., the opening out to the sea, may thus be more easily adapted to the exterior hull surface, permitting attainment of a smooth area in this region, without cumbersome projections.

In some cases it may be appropriate to improve further the supply of cooling water by providing in the first opening a lip projecting beyond the side of the boat, which lip has the effect of directing the cooling water into the opening. The remaining area around the first opening or intake opening may advantageously be smooth and uniformly integrated into the outer surface of the boat hull, as mentioned above.

According to the invention, it has proven particularly expedient to have the interior confines of the duct, seen in longitudinal section perpendicular to the side or bottom of the boat, substantially and gradually rounded off from the first opening and inward into the duct.

It has also proven particularly advantageous for the configuration of the duct cross-section to be flattened near the first opening and progress into a conventional circular cross-section toward the second opening.

After the curve in the duct, as mentioned above, the duct may be oriented in a direction convenient for connection to the motor and/or for the mounting of a stop valve.

The invention may advantageously be realized by utilizing a method wherein the cooling water intake is fabricated in situ. According to the invention, therefore, we propose a method for fabrication of a cooling water intake body aboard a boat, wherein the intake comprises a first opening in the boat hull facing toward the sea, a duct for water from the opening, and a second opening at the mouth of the duct, which second opening is adapted for connection to the cooling system of a motor, said method being characterized in that a hole is made in the boat hull, that a core member corresponding to the duct is provided, that said core member is positioned in said hole in the boat hull against a formwork element covering the hole on the outside of the boat hull, and that the cooling water intake body is built up around the core member while being simultaneously fixed in the hole in the boat hull.

The core member may advantageously be connected with a prefabricated pipe sleeve, or take-off piece, prior to building up the cooling water intake body, which sleeve is integrated into the cooling water intake body and serves as a connection to the motor's cooling water system.

BRIEF DESCRIPTION OF THE DRAWINGS

The invention will be explained further with reference to the drawings, wherein:

FIG. 1 shows a section through a cooling water intake according to the invention, FIG. 2 shows a cross-section of the cooling water intake in FIG. 1 along the indicated sectional line A—A, FIG. 3 shows a section along sectional line B—B in FIG. 1, FIG. 4 shows a section taken from the area surrounding the first opening in the cooling water intake, FIG. 5 shows a further modified embodiment of the area around the first opening in the cooling water intake, FIG. 6 shows a second cooling water intake according to the invention, viewed from the seaward side, FIG. 7 shows a longitudinal section of the embodiment in FIG. 6, and FIG. 8 illustrates the fabrication in situ of a cooling water intake.

DETAILED DESCRIPTION OF THE PREFERRED EMBODIMENT

The cooling water intake shown in FIG. 1 is constructed as an integral body 1 from a suitable composite material. Body 1 has a duct 2 running from a first opening 3 to a second opening 4. Around said first opening 3, which is the cooling water intake's opening to the sea, is provided a flange-like expansion 5, and a corresponding coupling flange 6 is provided around the second opening 4.

Cooling water intake 1 is inserted into an opening 7 in a boat hull skin 8 with the aid of flange 5 and is fixed thereto by suitable means: it may, for example, be glued in place or fastened with screws, or both. Flange 6 is adapted for flange coupling with the motor's cooling water system, not shown.

In FIGS. 2 and 3 the cross-sections of the duct according to sectional lines A—A and B—B, respectively, are shown. As is apparent therefrom, the duct cross-section has a flattened configuration in the area near the first opening 3, while the duct cross-section at the second opening 4 has the circular shape shown in FIG. 2.

In the section through the cooling water intake shown in FIG. 1—a longitudinal section perpendicular to the side or bottom 8 of the boat—the interior confines 9 of the duct are substantially and gradually rounded off from the first opening 3 and inward into duct 2.

In FIG. 1 the cooling water intake 1 is flush with the exterior side of hull skin 8. The sharp edged transition at 10 in FIG. 1 is depicted in a more rounded-off form by 10' in FIG. 4.

FIG. 5 indicates how, in the longitudinal section perpendicular to the boat side/bottom, there may be provided in the first opening a lip 11 projecting beyond the side of the boat.

The cooling water intake in FIG. I has, as shown, a duct 2 that is curved inward and toward the stern. The vessel's normal direction of travel is indicated by arrow F in FIGS. 1, 4 and 5.

The cooling water intake shown in FIGS. 6 and 7 differs from that shown in FIG. 1 only in that it is designed with an inverted flange 12 to facilitate the mounting of the intake in a somewhat thicker boat hull skin 13, as shown here, and is constructed, for example, as a composite of fiber-reinforced plastic and plywood. In addition, flange 6 is replaced by an externally threaded section 14.

FIG. 8 shows how the cooling water intake according to the invention may be constructed in situ. A hole 16 is made in boat hull 15. The hole is covered with a formwork element 17. A core member 18, designed in conformity with the desired shape of the duct, is positioned on formwork element 17. Onto said core member is placed a pipe sleeve 19, or take-off piece, provided with flange 20. Around the core member is constructed a body 21, indicated by dotted lines. The material that is used may be, for example, fiber-reinforced plastic of the same type as that used in boat hull 15. The pipe sleeve 19 is integrated into the body, which is in turn integrated into the boat hull. After building up the body, the core member is removed.

I claim:

1. A cooling water intake for use aboard a boat, comprising:

a first opening to sea in a boat hull;

a duct for water from the first opening, wherein interior confines of said duct, in a longitudinal section perpendicular to a boat side/bottom, are substantially and gradually rounded off from the first opening and inward into the duct, such that the cooling water intake is flush with an exterior side of the boat hull;

a second opening at a mouth of the duct, the second opening being adapted for connection to a cooling system of a motor of the boat, said duct being curved inward and toward a stern of the boat from said first opening; and wherein a cross-section of the duct proximate the first opening has a flattened, oval configuration and toward the second opening progresses into a circular cross-section.

2. A cooling water intake according to claim 1, wherein an integral body of the cooling water intake is constructed from a composite material.

3. A cooling water intake according to claim 1, wherein exterior confines of the duct, in a longitudinal section perpendicular to the boat side/bottom, form a streamlined lip projecting beyond the side of the boat hull in the first opening therein.

4. A method for fabrication of a cooling water intake body aboard a boat, comprising the steps of:

providing the cooling water intake body which comprises:

a first opening in a boat hull facing toward sea;

a duct for water from the first opening, interior confines of said duct are substantially and gradually rounded off from the first opening and inward into the duct, such that the cooling water intake body is flush with an exterior side of the boat hull;

a second opening at a mouth of the duct; and wherein a cross-section of the duct proximate the first opening has a flattened, oval configuration and toward the second opening progresses into a circular cross-section;

connecting the second opening to a cooling system of a motor of the boat;

providing a hole in the boat hull;

providing a core member corresponding to the duct;

positioning said core member in said hole in the boat hull against a formwork element covering the hole on outside of the boat hull; and building up the cooling water intake body around the core member while simultaneously being fixed in the hole in the boat hull.

5. A method according to claim 4, further comprising the step of joining the core member to a prefabricated pipe sleeve, or take-off piece, prior to building up the cooling water intake body, wherein the pipe sleeve is integrated into the cooling water intake body.

* * * * *

UNITED STATES PATENT AND TRADEMARK OFFICE

CERTIFICATE OF CORRECTION

PATENT NO. : 5,607,333

DATED : March 4, 1997

INVENTOR(S) : Rolf Kvamsdal

It is certified that error appears in the above-identified patent and that said Letters Patent is hereby corrected as shown below:

col. 3, line 27, "FIG. I" should read --FIG. 1--

Signed and Sealed this

Twenty-fifth Day of November, 1997

*Attest:*

Bruce Lehman

BRUCE LEHMAN

*Attesting Officer*

*Commissioner of Patents and Trademarks*